US009125241B2

(12) United States Patent
Aritaki et al.

(10) Patent No.: US 9,125,241 B2
(45) Date of Patent: Sep. 1, 2015

(54) HEATER AND METHOD FOR MANUFACTURING THE SAME

(75) Inventors: Yasuyuki Aritaki, Kyoto (JP); Shinobu Obata, Kyoto (JP); Teruhisa Sako, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 873 days.

(21) Appl. No.: 12/527,088

(22) PCT Filed: Feb. 12, 2008

(86) PCT No.: PCT/JP2008/052224

§ 371 (c)(1),
(2), (4) Date: Aug. 13, 2009

(87) PCT Pub. No.: WO2008/099798

PCT Pub. Date: Aug. 21, 2008

(65) Prior Publication Data

US 2010/0032427 A1 Feb. 11, 2010

(30) Foreign Application Priority Data

Feb. 13, 2007 (JP) ..... 2007-031639
Jun. 19, 2007 (JP) ..... 2007-161040

(51) Int. Cl.

| | |
|---|---|
| ***H05B 3/10*** | (2006.01) |
| ***H05B 3/02*** | (2006.01) |
| ***H05B 1/00*** | (2006.01) |
| ***H05B 11/00*** | (2006.01) |
| ***H05B 3/03*** | (2006.01) |
| ***H05B 3/26*** | (2006.01) |
| *G03G 15/20* | (2006.01) |
| *H05B 3/16* | (2006.01) |
| *H05B 3/14* | (2006.01) |

(52) U.S. Cl.

CPC .. *H05B 3/03* (2013.01); *H05B 3/26* (2013.01); *G03G 15/2064* (2013.01); *H05B 3/146* (2013.01); *H05B 3/16* (2013.01); *H05B 2203/013* (2013.01); *H05B 2203/017* (2013.01); *Y10T 29/49083* (2015.01)

(58) Field of Classification Search

CPC ..... H05B 3/10; H05B 3/12; H05B 3/146; H05B 3/16; H05B 3/00; B06D 1/32; B06D 1/36; B06D 3/02; B06D 5/12; B06D 7/50; G03G 15/2064; H01B 1/128; H01B 1/22; H01L 2924/01079; H01L 2924/01078; H05K 3/429; H05K 1/162; H05K 2201/093; H01C 17/20; Y02E 60/12; C25B 11/0478; C23C 26/00; G03C 1/74

USPC ..... 219/548, 546, 201, 216; 29/611; 252/500, 514; 174/260; 361/760, 361/792–795; 427/101, 123, 125, 383.1, 427/402

See application file for complete search history.

(56) References Cited

FOREIGN PATENT DOCUMENTS

JP 2002075599 A * 3/2002 ..... H05B 3/16
JP 2002108120 A * 4/2002 ..... G03G 15/20

(Continued)

*Primary Examiner* — Dana Ross
*Assistant Examiner* — Hemant Mathew
(74) *Attorney, Agent, or Firm* — Hamre, Schumann, Mueller & Larson, P.C.

(57) ABSTRACT

A heater (A1) includes a substrate (1), a heating resistor (2) formed on the substrate (1) and an electrode (3) electrically connected to the heating resistor (2) and containing a metal component. The heater (A1) further includes a diffusion prevention layer (4) which is held in contact with at least part of the electrode (3) and prevents the metal component from diffusing from the electrode (3). By preventing the diffusion of the metal component from the electrode (3) to the heating resistor (2), the separation of the heating resistor (2) and the electrode (3) is prevented.

14 Claims, 6 Drawing Sheets

(56) References Cited

FOREIGN PATENT DOCUMENTS

| | | | | | |
|---|---|---|---|---|---|
| JP | 2002289328 | A | * | 10/2002 | ..... H05B 3/18 |
| JP | 2004-6289 | | | 1/2003 | |
| JP | 2003-109727 | | | 4/2003 | |
| JP | 2003109727 | A | * | 4/2003 | ..... H05B 3/20 |
| JP | 2004006289 | A | * | 1/2004 | ..... H05B 3/16 |
| JP | 2006351366 | A | * | 12/2006 | |

* cited by examiner

HEATER AND METHOD FOR MANUFACTURING THE SAME

TECHNICAL FIELD

The present invention relates to a heater used in e.g. a laser printer for thermally fixing toner transferred to recording paper. The present invention also relates to a method for manufacturing such a heater.

BACKGROUND ART

FIG. 10 shows an example of conventional heater. The heater X illustrated in the figure includes a substrate 91, a heating resistor 92, an electrode 93 and a protective film 94. The substrate 91 is in the form of an elongated rectangle and made of an insulating material. The heating resistor 92 is made of e.g. Ag—Pd and formed in the form of a strip on the substrate 91. The electrode 93 is for supplying electrical power to the heating resistor 92 and mainly made of Ag. The protective film 94 is made of e.g. glass and covers the heating resistor 92 and part of the electrode 93. The heater X is used for thermally fixing toner to recording paper. When electrical power is applied from a power supply to the heating resistor 92, the heating resistor 92 generates heat. Recording paper to which toner has been transferred is pressed against the heater X in the heated state using a platen roller. As a result, toner is fixed to the recording paper.

The heater X has a drawback that the separation of the heating resistor 92 and the electrode 93 may occur. The separation can be caused by generation of bubbles or deterioration of the bonding strength due to the diffusion of Ag contained in the electrode 93. The separation generally tends to occur at the portion where the heating resistor 92 and the electrode 93 overlap each other. When the separation occurs in the manufacturing process, the heater X is disposed of as a defective product. When the bonding between the heating resistor 92 and the electrode 93 is deteriorated during the use, the heating resistor 92 is not heated sufficiently, which hinders proper printing.

Patent Document 1: JP-A-2004-6289

DISCLOSURE OF THE INVENTION

The present invention has been proposed under the circumstances described above. It is, therefore, an object of the present invention to provide a heater which is capable of preventing the separation of a heating resistor and an electrode and a method for manufacturing such a heater.

To achieve the object, the present invention takes the following technical measures.

A heater provided according to a first aspect of the present invention includes a substrate, a heating resistor formed on the substrate, and an electrode electrically connected to the heating resistor and containing a metal component. The heater further includes a diffusion prevention layer which is held in contact with at least part of the electrode and prevents the metal component from diffusing from the electrode.

In a preferred embodiment of the present invention, the diffusion prevention layer is disposed between the heating resistor and the electrode.

In a preferred embodiment of the present invention, the diffusion prevention layer contains a higher percentage of Pd than the electrode.

In a preferred embodiment of the present invention, the heater further includes a protective film covering the heating resistor and made of glass. The diffusion prevention layer contains glass having a softening point that is equal to or higher than the softening point of the glass forming the protective film.

In a preferred embodiment of the present invention, the electrode comprises a connection pad spaced from the heating resistor and an extension extending from the connection pad to the heating resistor.

A method for manufacturing a heater provided according to a second aspect of the present invention includes the steps of: applying a conductor paste, a glass conductor paste and a resistor paste on a substrate in a manner such that the glass conductor paste is disposed between the conductor paste and the resistor paste; and forming an electrode, a diffusion prevention layer and a heating resistor by collectively baking at least the glass conductor paste and the resistor paste.

In a preferred embodiment of the present invention, the method further includes the step of forming a protective film to cover the heating resistor by utilizing glass having a softening point that is equal to or lower than the softening point of the glass contained in the glass conductor paste after the baking step.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
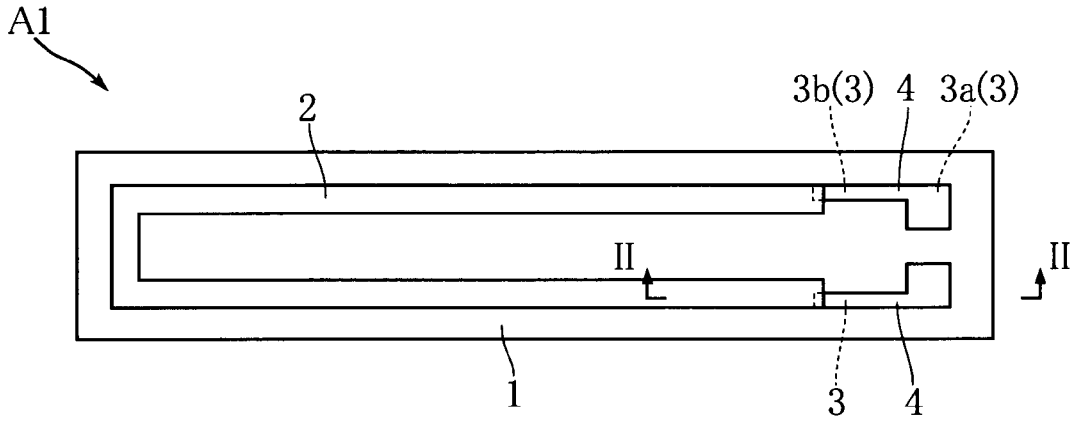
FIG. 1 is a plan view showing a principal portion of a heater according to a first embodiment of the present invention.
Figure 2:
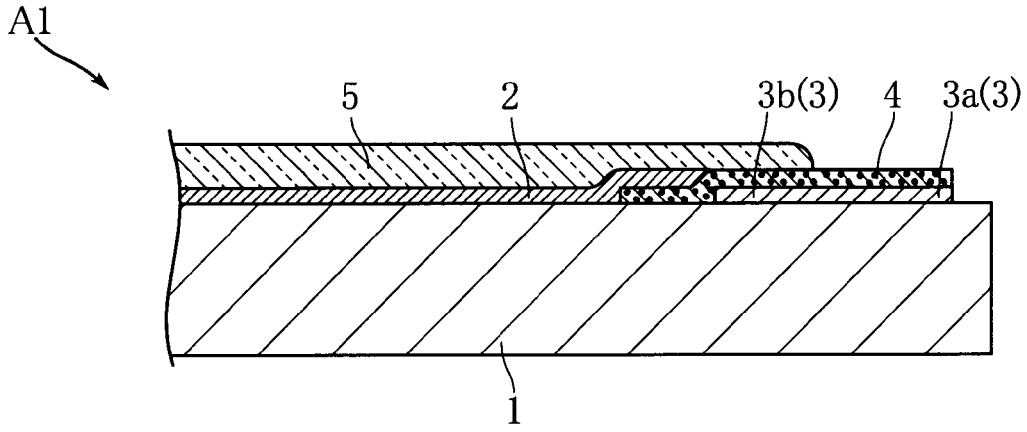
FIG. 2 is a sectional view taken along lines II-II in FIG. 1.

FIGS. 1 and 2 show a heater according to a first embodiment of the present invention. The heater A1 of this embodiment includes a substrate 1, a heating resistor 2, an electrode 3, a diffusion prevention layer 4 and a protective film 5. The heater A1 is used in e.g. a laser printer to thermally fix toner transferred to recording paper. For easier understanding, the illustration of the protective film 5 is omitted in FIG. 1.

The substrate 1 is in the form of an elongated rectangle and made of an insulating material. Examples of the insulating material include AlN and $Al_2O_3$.

The heating resistor 2 is provided on the substrate 1 and in the form of a generally U-shaped strip. The heating resistor 2 includes, as a resistive material, Ag—Pd. The proportion of Pd in Ag—Pd is e.g. 50 to 60 wt %. The particle size of Ag contained in the heating resistor 2 is about 1.0 to 3.0 μm. The heating resistor 2 further includes crystallized glass such as $SiO_2$—$B_2O_3$—R-based glass or $SiO_2$—$B_2O_3$—$Al_2O_3$—R-based glass (where R is any of $ZnO_2$, $LiO_2$ and $TiO_2$). The sheet resistance of the heating resistor 2 is e.g. 100 to 2000 mΩ/□.

The electrode 3 is used for supplying electrical power from a power supply (not shown) to the heating resistor 2. The electrode 3 is mainly made of Ag. The particle size of Ag contained in the electrode 3 is about 1.0 to 3.0 μm. The electrode 3 may contain 5 wt % or less of Pd. The sheet resistance of the electrode 3 is e.g. 1 to 10 mΩ/□. The electrode 3 includes a connection pad 3*a* and an extension 3*b*. The connection pad 3*a* is substantially square and spaced from the heating resistor 2. In incorporating the heater A1 into e.g. a laser printer, e.g. a connector (not shown) is connected to the connection pad 3*a*. The extension 3*b* is in the form of a strip extending from the connection pad 3*a* to the heating resistor 2 and has a width smaller than the length of a side of the connection pad 3*a*.

The diffusion prevention layer 4 is mainly made of Ag and held in contact with at least part of the electrode 3. The particle size of Ag contained in the diffusion prevention layer 4 is about 1.0 to 3.0 μm. In this embodiment, the diffusion prevention layer 4 further contains Pd and glass. The content percentage of Pd in the diffusion prevention layer 4 is higher than that in the electrode 3 and may be 5 to 15 wt %. The glass contained in the diffusion prevention layer 4 is crystallized glass such as $SiO_2$—BaO—$Al_2O_3$—ZnO. In this embodiment, the diffusion prevention layer 4 covers the entirety of the electrode 3. Thus, the diffusion prevention layer 4 intervenes between the heating resistor 2 and the electrode 3, and the heating resistor 2 and the electrode 3 are not held in direct contact with each other. For easier understanding, the glass contained in the diffusion prevention layer 4 is illustrated as small circles in FIG. 2 and the subsequent drawings. The sheet resistance of the diffusion prevention layer 4 may be 10 to 100 mΩ/□.

The protective film 5 is provided for protecting the heating resistor 2 and covers the heating resistor 2 and part of the electrode 3 and diffusion prevention layer 4. The protective film 5 is made of glass whose softening point is equal to or lower than that of the glass contained in the diffusion prevention layer 4. In this embodiment, the diffusion prevention layer 4 has a laminated structure made up of e.g. a crystallized glass such as $SiO_2$—BaO—$Al_2O_3$—ZnO-based glass, a semi-crystalline glass such as BaO—$SiO_2$-based glass and an amorphous glass such as $SiO_2$—ZnO—MgO-based glass.

A method for manufacturing the heater A1 will be described below with reference to FIGS. 3 and 4.

Figure 3:
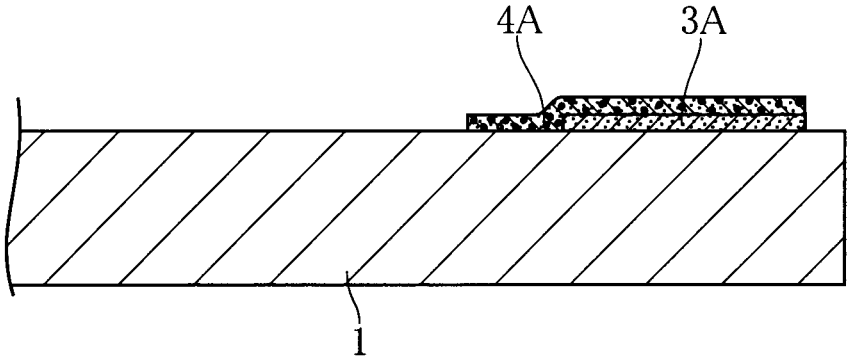
FIG. 3 is a sectional view showing the state in which a conductor paste and a glass conductor paste are applied on a substrate in a process step of a method for manufacturing the heater shown in FIG. 1.

First, as shown in FIG. 3, a conductor paste 3A and a glass conductor paste 4A are applied on a substrate 1 in the mentioned order. The conductor paste 3A is prepared by mixing Ag into a binder and later becomes an electrode 3. The glass conductor paste 4A is prepared by mixing Ag, Pd and glass into a binder and later becomes a diffusion prevention layer 4. The content percentage of Pd is e.g. 5 to 15 wt %. After applied onto the substrate, the conductor paste 3A and the glass conductor paste 4A are dried.

Figure 4:
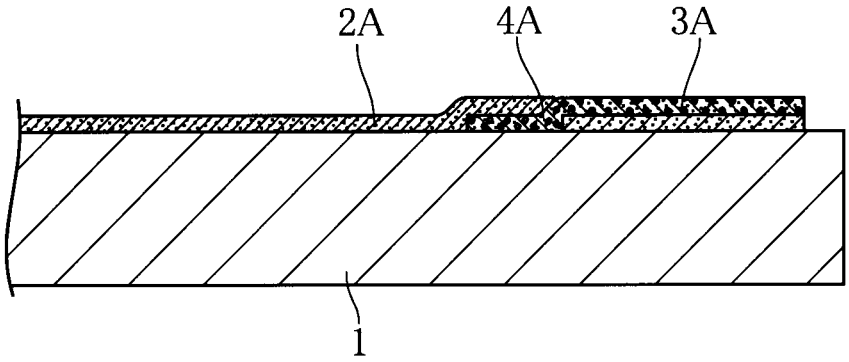
FIG. 4 is a sectional view showing the state in which a resistor paste is applied in a process step of the method for manufacturing the heater shown in FIG. 1.

Then, as shown in FIG. 4, a resistor paste 2A is applied so that part of the resistor paste 2A overlaps the glass conductor paste 4A. The resistor paste 2A is prepared by mixing Ag—Pd and a small amount of glass into a binder. The resistor paste later becomes the heating resistor 2. After applied, the resistor paste 2A is dried. Thereafter, the conductor paste 3A, the glass conductor paste 4A and the resistor paste 2A are baked collectively. Thus, a heating resistor 2, a diffusion prevention layer 4 and an electrode 3 are formed. Finally, a protective film 5 is formed, whereby a heater A1 is obtained.

The advantages of the heater A1 and the manufacturing method will be described below.

The present invention aims to prevent the separation of the heating resistor 2 and the electrode 3. The generation of bubbles at the portion where the heating resistor 2 and the electrode 3 overlap each other is considered to be a cause of the separation. The inventors of the present invention have found that the generation of bubbles is promoted by the diffusion of Ag from the electrode 3 to the heating resistor 2 in the manufacturing process.

In this embodiment, the heating resistor 2 and the electrode 3 are not arranged in direct contact with each other. The diffusion prevention layer 4 intervening between these elements contains a relatively large amount of Pd. Since Pd has a function to bind Ag, Ag is hardly diffused from the diffusion prevention layer 4. Further, the diffusion prevention layer 4 prevents the diffusion of Ag from the electrode 3 to the heating resistor 2. Thus, this arrangement is suitable for preventing the separation of the heating resistor 2. The diffusion prevention layer 4 containing a relatively large amount of Pd easily becomes porous. Thus, even when bubbles are generated from the substrate 1 or the nearby portion, the bubbles are properly released.

The extension 3*b* and the diffusion prevention layer 4 overlap each other at the region between the connection pad 3*a* and the heating resistor 2. The resistance of the diffusion prevention layer 4 is relatively high, because glass, which is an insulator, is contained in the layer. As compared to this, the resistance of the extension portion 3*b* made of Ag, which is a good conductor, is considerably low. Thus, at the region where the diffusion prevention layer 4 and the extension 3*b* overlap each other, current flows selectively to the extension 3*b*. Thus, the resistance of the entire heater A1 is prevented from increasing.

In the baking process to form the protective film 5, the baking temperature is so set that the glass in the protective film 5 is sufficiently solidified and does not unduly move due to baking. Such a baking temperature is not much higher than the softening point of the glass. The diffusion prevention layer 4 contains glass whose softening point is equal to or higher than that of the glass forming the protective film 5. Thus, in the baking process to form the protective film 5, the diffusion prevention layer 4 formed in advance reliably keeps the solidified state and does not become flowable. Thus, Ag, which is the main component of the diffusion prevention layer 4, is bound by glass. Thus, diffusion of Ag from the diffusion prevention layer 4 to the heating resistor 2 is prevented. As a result, bubbles are not generated at the portion where the heating resistor 2 and the electrode 3 overlap each other, so that the separation of the heating resistor 2 and the electrode 3 is prevented.

For comparison with this embodiment, a method is considered in which the resistor paste 2A is applied after the electrode 3 and the diffusion prevention layer 4 are formed by baking. In this case, in the process of applying, drying and baking the resistor paste 2A, Ag diffuses from the diffusion prevention layer 4 having a higher Ag concentration to the resistor paste 2A or the heating resistor 2 having a lower Ag concentration. As a result, minute pores are formed in the diffusion prevention layer 4 at the portion held in contact with the heating resistor 2. The minute pores may induce the separation of the heating resistor 2 and the diffusion prevention layer 4.

In this embodiment, however, the baking of the resistor paste 2A is begun, with the conductor paste 3A and the glass conductor paste 4A unbaked. Thus, even when Ag diffuses from the glass conductor paste 4A having a higher Ag concentration to the resistor paste 2A having a lower Ag concentration, the minute regions in the glass conductor paste 4A in which Ag has existed are filled with glass. Thus, minute pores are prevented from being formed in the diffusion prevention layer 4 at the region held in contact with the heating resistor 2. Thus, the bonding strength between the heating resistor 2 and the diffusion prevention layer 4 is enhanced. Alternatively, the diffusion prevention layer 4 and the heating resistor 2 may be formed by the above-described process after the electrode 3 is formed by baking. With this method again, the bonding strength between the heating resistor 2 and the diffusion prevention layer 4 is enhanced.

FIGS. 5-9 illustrate other embodiments of the present invention. In these figures, the elements which are identical or similar to those of the foregoing embodiment are designated by the same reference signs as those used for the foregoing embodiment.

Figure 5:
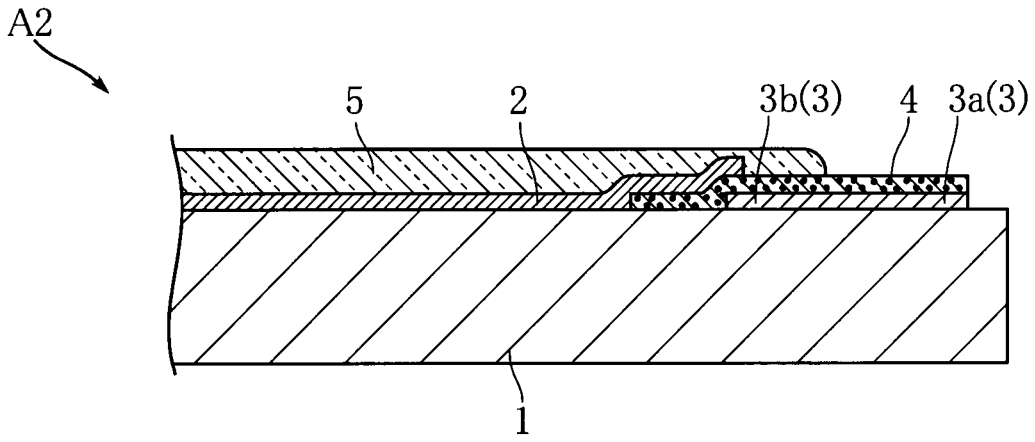
FIG. 5 is a sectional view showing a principal portion of a heater according to a second embodiment of the present invention.

FIG. 5 shows a heater according to a second embodiment of the present invention. The heater A2 of this embodiment differs from that of the foregoing embodiment in position of the end of the heating resistor 2. In this embodiment, the heating resistor 2 overlaps part of the electrode 3 by extending beyond the portion of the diffusion prevention layer 4 which projects from the electrode 3.

In this embodiment again, the separation of the heating resistor 2 and the electrode 3 is prevented. The diffusion prevention layer 4 overlaps at least one of the heating resistor 2 and the electrode 3. Thus, the current applied to the heater A2 flows to both of the diffusion prevention layer 4 and the heating resistor 2 or both of the diffusion prevention layer 4 and the electrode 3. This prevents excessive heat generation at part of the diffusion prevention layer 4.

Figure 6:
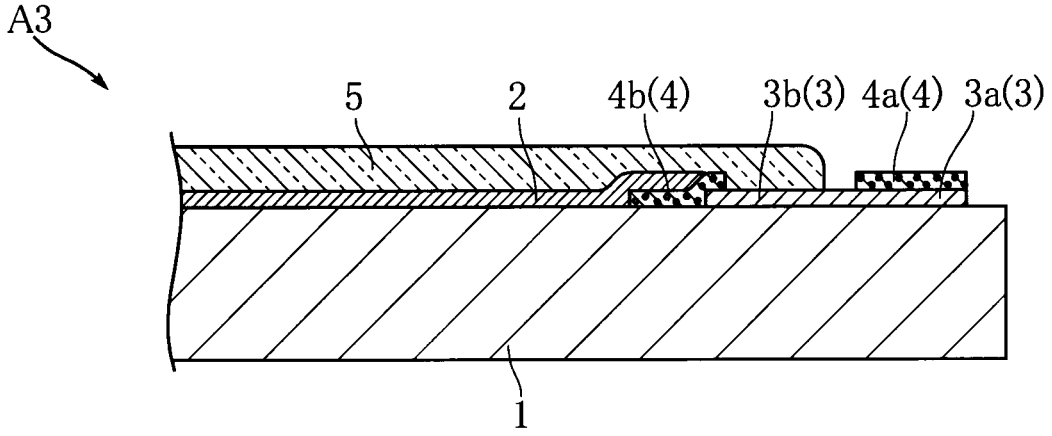
FIG. 6 is a sectional view showing a principal portion of a heater according to a third embodiment of the present invention.

FIG. 6 shows a heater according to a third embodiment of the present invention. The heater A3 of this embodiment differs from any of the foregoing embodiments in shape of the diffusion prevention layer 4. Specifically, in this embodiment, the diffusion prevention layer 4 is made up of an intervening portion 4*b* and a pad portion 4*a*. The intervening portion 4*b* is disposed between the heating resistor 2 and the electrode 3. The pad portion 4*a* is exposed out of the protective film 5 and may be rectangular in plan view. In this embodiment again, the separation of the heating resistor 2 and the electrode 3 is prevented. The pad portion 4*b* is suitably utilized as a part to be clipped by a power supply clip for supplying power to the heater A3.

Figure 7:
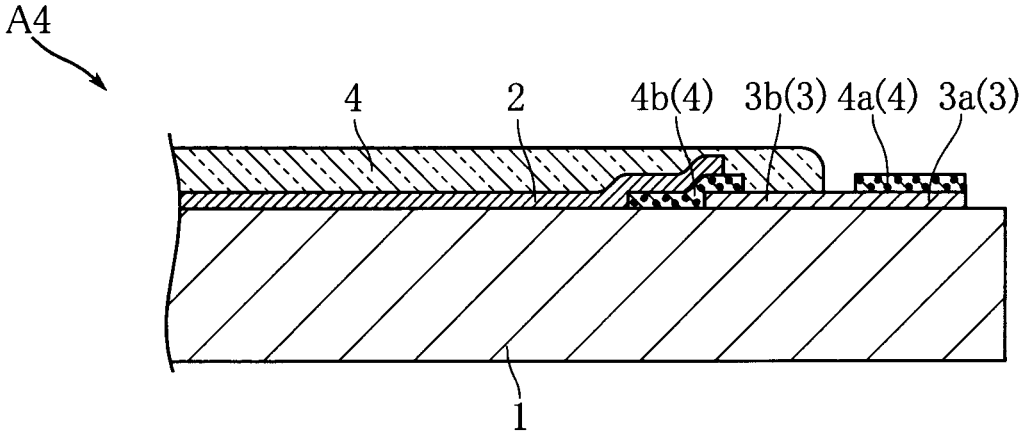
FIG. 7 is a sectional view showing a principal portion of a heater according to a fourth embodiment of the present invention.

FIG. 7 shows a heater according to a fourth embodiment of the present invention. In the heater A4 of this embodiment, the diffusion prevention layer 4 is made up of an intervening portion 4*b* and a pad portion 4*a* similarly to the heater A3, and the heating resistor 2 overlaps part of the electrode 3 similarly to the heater A2. In this embodiment again, the effect which the present invention aims at is provided.

Figure 8:
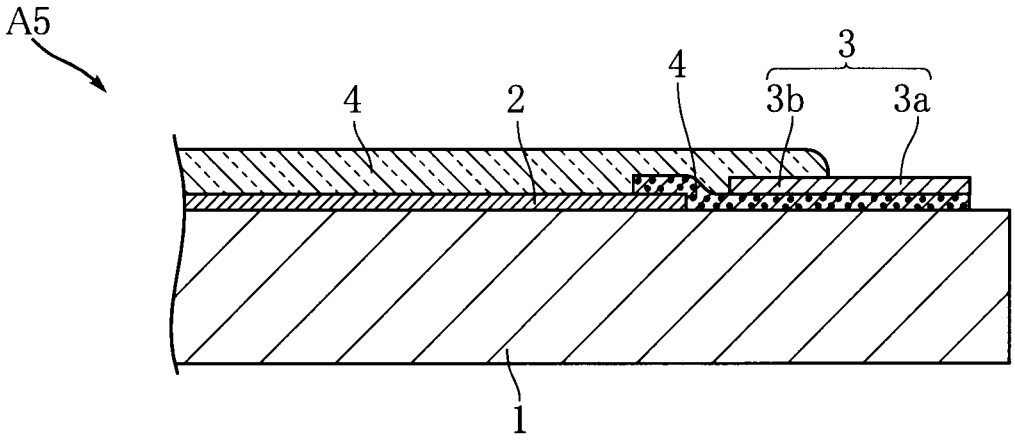
FIG. 8 is a sectional view showing a principal portion of a heater according to a fifth embodiment of the present invention.

FIG. 8 shows a heater according to a fifth embodiment of the present invention. The heater A5 of this embodiment differs from the foregoing embodiments in that the diffusion prevention layer 4 is disposed between the substrate 1 and the electrode 3. In this embodiment, the diffusion prevention layer 4 prevents the diffusion of Ag from the electrode 3 to the substrate 1. Thus, the generation of bubbles due to the reaction between the substrate 1 and Ag is suppressed.

Figure 9:
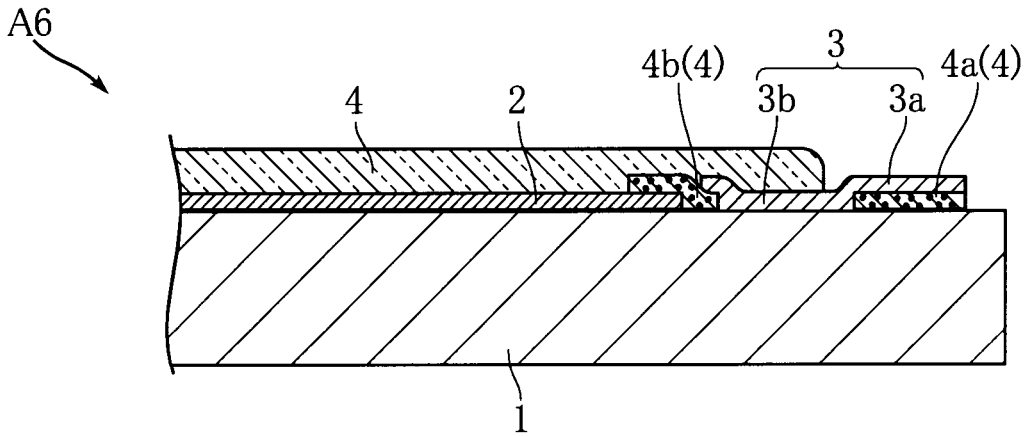
FIG. 9 is a sectional view showing a principal portion of a heater according to a sixth embodiment of the present invention.
Figure 10:
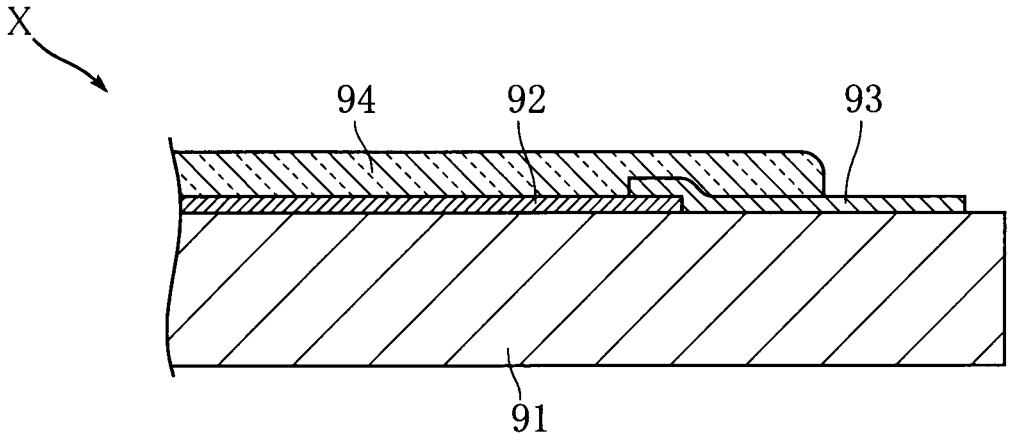
FIG.10 Prior Art
FIG. 10 is a sectional view showing a principal portion of a conventional heater.

FIG. 9 shows a heater according to a sixth embodiment of the present invention. In the heater A6 of this embodiment, the diffusion prevention layer 4 is made up of an intervening portion 4*b* and a pad portion 4*a*. The pad portion 4*b* is disposed between the connection pad portion 3*a* of the electrode 3 and the substrate 1. In this embodiment again, the separation of the heating resistor 2 and the electrode 3 is prevented.

The heater and the manufacturing method according to the present invention are not limited to the foregoing embodiments. The specific structure of the heater and the manufacturing method may be varied in design in many ways.

In the heater according to the present invention, it is preferable that the content percentage of Pd in the diffusion prevention layer is higher than that in the electrode. Thus, the electrode may not contain Pd at all. Further, unlike the foregoing embodiment, the glass contained in the diffusion prevention layer may not be the same glass as that forming the protective film. For instance, a glass whose softening point is higher than the glass forming the protective film may be contained in the diffusion prevention layer.

The invention claimed is:

1. A heater comprising:

a substrate;

a heating resistor formed on the substrate;

an electrode electrically connected to the heating resistor; and a diffusion prevention layer;

wherein the heating resistor, the electrode and the diffusion prevention layer each contain Ag, wherein the diffusion prevention layer covers at least part of the electrode and intervenes between the heating resistor and the covered part of the electrode, and contains a higher percentage of Pd than the electrode, and wherein the heating resistor contains a higher percentage of Pd than the diffusion prevention layer.

2. The heater according to claim 1, wherein the heater further comprises a protective film covering the heating resistor and made of glass;

wherein the diffusion prevention layer contains glass having a softening point that is equal to or higher than a softening point of the glass forming the protective film.

3. The heater according to claim 1, wherein the electrode comprises a connection pad spaced from the heating resistor and an extension extending from the connection pad to the heating resistor.

4. A method for manufacturing a heater, the method comprising the steps of:

applying a conductor paste, a glass conductor paste and a resistor paste on a substrate in a manner such that the glass conductor paste is disposed between the conductor paste and the resistor paste and that the conductor paste and the resistor paste are held out of direct contact with each other; and forming an electrode, a diffusion prevention layer and a heating resistor by collectively baking at least the glass conductor paste and the resistor paste;

wherein the diffusion prevention layer covers at least part of the electrode and intervenes between the heating resistor and the electrode, and contains a higher percentage of Pd than the electrode.

5. The method for manufacturing the heater according to claim 4, further comprising the step of forming a protective film to cover the heating resistor by utilizing glass having a softening point that is equal to or lower than a softening point of the glass contained in the glass conductor paste after the baking step.

6. The heater according to claim 1, wherein the diffusion prevention layer further contains glass.

7. The heater according to claim 1, further comprising a protective cover, wherein the heating resistor and the diffusion prevention layer include respective overlapping portions that overlap each other, and the protective cover covers the overlapping portions.

8. The heater according to claim 1, wherein the diffusion prevention layer substantially entirely covers an upper surface of the electrode.

9. The heater according to claim 1, wherein the heating resistor overlaps at least part of the electrode as viewed in a thickness direction of the substrate.

10. The heater according to claim 1, wherein the heating resistor is spaced apart from the electrode as viewed in a thickness direction of the substrate.

11. The heater according to claim 3, wherein the diffusion prevention layer includes a pad portion formed on the connection pad.

12. The heater according to claim 11, wherein the diffusion prevention layer includes an intervening portion spaced apart from the pad portion, the intervening portion being disposed between the heating resistor and the electrode.

13. The heater according to claim 12, wherein the pad portion and the intervening portion contain a same percentage of Pd.

14. The heater according to claim 7, wherein the protective cover covers the entirety of the diffusion prevention layer.

* * * * *